United States Patent [19]

Steinhauser

[11] Patent Number: 4,759,208

[45] Date of Patent: Jul. 26, 1988

[54] DEVICE FOR THE AUTOMATIC TRANSFER OF WORKPIECES ON A MULTISTAGE FORMING MACHINE

[75] Inventor: Ulrich Steinhauser, Allschwil, Switzerland

[73] Assignee: Hatebur Unformmaschinen AG, Reinach, Switzerland

[21] Appl. No.: 874,489

[22] Filed: Jun. 16, 1986

[30] Foreign Application Priority Data

Jun. 24, 1985 [CH] Switzerland ..... 2680/85

[51] Int. Cl.[4] ..... B21J 11/00

[52] U.S. Cl. ..... 72/405; 72/361; 72/423; 198/740; 414/751

[58] Field of Search ..... 72/361, 404, 405, 421, 72/422, 423; 198/740, 741, 739; 414/750, 751

[56] References Cited

U.S. PATENT DOCUMENTS

| | | | |
|---|---|---|---|
| 3,754,667 | 8/1973 | Storch | 198/740 |
| 4,186,589 | 2/1980 | Criblez | 72/405 |
| 4,404,837 | 9/1983 | Allen et al. | 72/405 |
| 4,428,221 | 1/1984 | Owens | 72/405 |

FOREIGN PATENT DOCUMENTS

| | | | |
|---|---|---|---|
| 406109 | 8/1966 | Switzerland | 72/405 |
| 1308245 | 2/1973 | United Kingdom | 72/405 |

*Primary Examiner*—W. Donald Bray
*Attorney, Agent, or Firm*—Ladas & Parry

[57] ABSTRACT

The proposed cross transfer device has two parallel support tubes (2a, 2b) which are displaceable in reciprocating manner in the workpiece transfer direction in the forming area and to which are fixed in each case an upper and a lower gripper box (3a, 3b). The two gripper boxes are used for the rectilinear guidance of gripper jaws (11) which interact in pairs, seize a workpiece at each forming station (U1 to U3) and can be transferred to the in each case adjacent forming station (U2 to U4) and released again. Transmission levers (6a, 6b) pivotably mounted in the gripper boxes (3a, 3b) are used for driving the gripper jaws (11), the pivoting movement of which transmission levers (6a, 6b) is controlled by a rotating camshaft (4a, 4b) which in each case is centrally mounted in one of the support tubes (2a, 2b) via antifriction bearings (15) and supporting pins (14). The cam members (5) of this camshaft are fan-type disks (5a, 5b) which can be adjusted in each case relative to the axis of rotation of the camshaft supporting it and relative to one another, so that each transmission lever (6a, 6b) can be individually set, independently of the further transmission levers provided, for controlling a certain gripper movement.

16 Claims, 7 Drawing Sheets

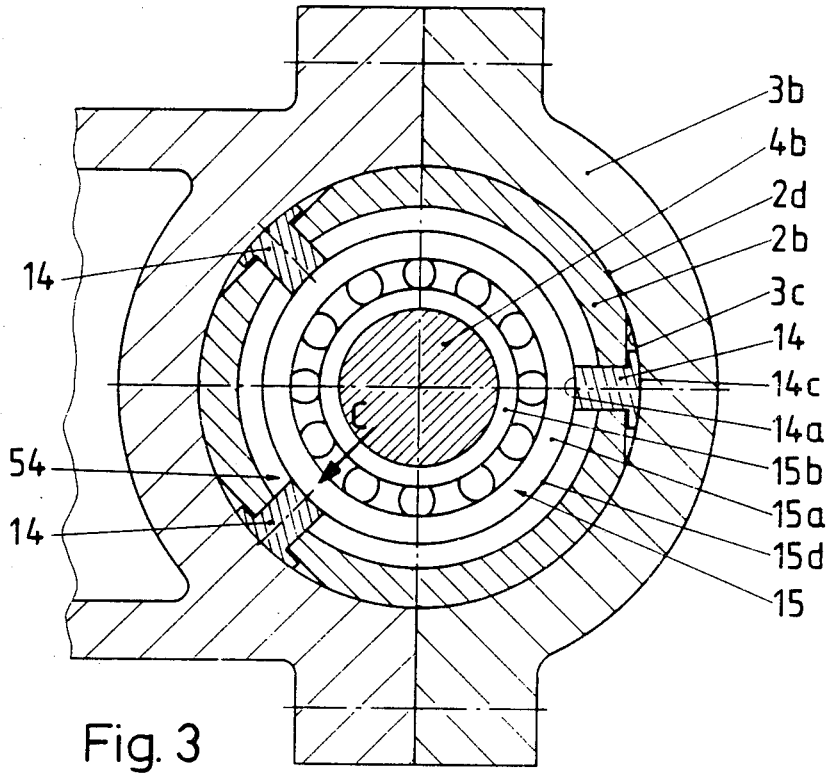
Fig. 3
Fig. 4
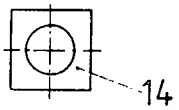

DEVICE FOR THE AUTOMATIC TRANSFER OF WORKPIECES ON A MULTISTAGE FORMING MACHINE

The invention relates to a device for the automatic transfer of workpieces on a multistage forming machine.

In a known forming machine (German Patent Speicification No. 2,715,966) of this type, drive shafts in the form of longitudinally displaceable and rotatably mounted camshafts are arranged in respective support tubes. The drive shafts are set in periodically oscillating pivoting motion via a drive device to shift transmission levers in the form of bell crank levers with cams of the cam shafts and, thereby, gripper jaws running in rectilinear guides.

Although the periodically oscillating drive shafts can be adjusted within certain limits, such an adjustment is only possible for all of the transmission levers actuated by a common drive shaft, so that, as a rule, only one gripper jaw thereof can be optimally set to the holding and transfer functions thereof determined by a workpiece and forming tools therefor. In a four stage forming machine, which requires three pairs of gripper jaws, additional measures are therefore necessary, such as, for example, particularly long retaining pins and long stamping punches at respective forming stations to be able to compensate, within certain limits, for the drawbacks which occur in connection with the holding and transfer functions.

In addition to the disadvantage already mentioned in the known periodically oscillating drive shafts, the known device is also considerably restricted with respect to a certain independence in the setting of the opening and closing movements of the gripper jaws, because one and the same cam portion always remains effective for both movement sequences.

The object of the invention, in a device of the type mentioned at the outset, is to design in particular the drive for the transmission levers while avoiding the disadvantages of the known drive, in such a way that the functional timing sequence in each gripper pair of an associated forming station, in relationship to the corresponding sequence at an adjacent forming station or further forming stations, can be selectively set independently of one another, in which case it is intended that such an adjustability can be implemented functionally and operationally reliably in a simple manner during the briefest interruption in production.

The solution to this object according to the invention is, instead of periodically oscillating drive shafts, continuously rotating camshafts rotatably mounted in support tubes. As a result, a continuous pivoting movement corresponding to the cam control surface is imparted to each transmission lever. In addition, the solution according to the invention characterizes a mutual adjustability of the individual cam members on the cam shaft, forming the drive shaft, with respect to the camshaft axis of rotation and relative to one another. This adjustability makes it possible to individually set a gripper pair or each individual gripper with regard to a quite definite opening and closing function which can be specified at each forming station.

A further particular advantage results from the use of rotationally driven camshafts in that the cam member to be selected can be shaped with relatively wide limits, because no longer is only one restricted pivoting area available for the control function of each cam member, as in the known device, but in each case a complete shaft rotation is available, as a result of which a conceptionally more favourable separation between the gripper opening and the closing movement sequences is achieved on the whole and more free play is thereby created in the actual gripper control.

A further particularly advantageous realization of the device according to the invention is provided when the cam members are fan-type disks which are detachably and adjustably attached on the camshaft and are provided with appropriate markings for setting predetermined rotational angular positions with respect to the camshaft axis of rotation. By the application of such fan-type disks a camshaft with adjustable cam members is created, the rotational angular positions to be selected of which, for an optimum drive of the respective transmission levers and therefore the gripper pairs, can follow quickly and simply with the aid of the provided markings when the camshafts are removed from the support tubes.

In this connection, a further aspect of the device according to the invention comprises the accommodation of a camshaft made up from fan-type disks, with the use of support tubes which are as light as possible for reasons of mass acceleration, inter alia, and the in this case restricted space conditions in the support tube inner space. According to a solution feature according to the invention, a bearing arrangement is provided in which, depending on the loads to be coped with by support means, in some or all camshaft portions which lie between adjacent fan-type disks and if necessary also next to the in each case outer fantype disks of a camshaft, a corresponding number of antifriction bearings are provided, the bearing outer rings of which have a smaller diameter than the inside diameter of the respective support tube. For supporting these antifriction bearings inside the support tubes several supporting pins are provided which are distributed over the relative outer ring, project through the wall of the support tube into the support tube inner space, bear against, for example, three locations on the outer ring periphery and hold the latter and therefore the antifriction bearing in the manner of a steady rest. Such a support of the antifriction bearings and therefore the camshafts inside the support tubes offers considerable technical advantages in the production, because the tube outside diamter of the respective support tube can be produced to close tolerances with known, comparatively simple measures, and the supporting pins, precision-machined accordingly, can be aligned, with a supporting force which can be adjusted if necessary, to the outer peripheral surface of the respective support tube for centering the respective antifriction bearing. Since the bearing arrangement is to be provided in particular inside the longitudinal extent of each gripper box, the inner surface of a clamped-on fixing portion of the gripper box, which inner surface bears against the outer peripheral surface of each support tube, can advantageously be used for the simple and at the same time functionally reliable fixing of the supporting pins in the radial direction of the support tube.

In the device according to the invention, an axial bearing is also provided on each camshaft on a portion facing toward the yoke, which axial bearing is firmly connected to the camshaft and can be coupled to the surrounding support tube via a detachable locking arrangement engaging on the camshaft, so that it can be displaced in the axial direction together with the support tube in the operationally ready condition of the device.

So that a rapid changeover of the gripper movement to a new workpiece is possible during a necessary production change, each camshaft can be removed from the associated support tube and replaces by a preset interchangeable shaft. Especially with regard to the rapid changeover capacity, which contributes substantially to the increase in the economy of the entire machine, the features of the inventive device which are stated in detail above are to be understood in their functional interaction. As a result of the support in the manner of a steady rest in the bearing arrangement, the latter does not offer any resistance, necessitating a large axial force, to the drawing of a camshaft out of the respective support tube, so that each camshaft can be drawn out of the support tubes manually after the locking arrangement is released and the shaft drive-side transmission lever portions bearing against the fan-type disks are lifted and also after the automatic uncoupling of the drive parts. Outside the support tubes, either the fan-type disks can be reset in a short time with the aid of the scales provided, or the camshafts, with fan-type disks already set, are completely interchanged. Since the camshafts in the device according to the invention are of identical construction and are designed to rotate in the same direction, the camshafts cannot be mixed up with respect to the support tubes, the consequence of which is to provide a certain facilitation during a necessary production change.

Further features and advantages, in particular concerning advantageous embodiments of the invention fall from the further patent claims, in which the features described in each case are claimed both in themseleves and in their in each case technically significant, functional combination.

In addition, it is of importance in connection with the device according to the invention that two differently constructed transmission levers with an oscillation pattern corresponding to one another can be controlled by means of the drive principle according to the invention. In a preferred embodiment, the transmission levers, which in each case are supported inside a gripper box on the support tube which is the upper support tube with respect to the forming area, are made as so-called double-arm levers, that is, the shaft drive-side lever portion of the transmission lever is located on one side of the articulation axis of this lever, whereas a gripper drive-side lever portion is provided on the other side of the abovementioned pivot axis. This results in an embodiment of the relevant gripper box which is longitudinally extended in the longitudinal direction of the transmission lever. On the other hand, the gripper box provided with respect to the forming area on the lower support tube is arranged with a transmission lever in the form of a single-arm lever, that is, the shaft drive-side and the gripper drive-side lever portion is provided on a common lever arm which, with respect to the pivot axis of the transmission lever, is allocated to the cross transfer area. The two parallel support tubes can thereby be arranged offset to one another, so that the lower support tube is at a smaller distance from the workpiece transfer plane than the upper support tube. This different embodiment of the gripper boxes and arrangement of the support tubes enables the space necessary for vertically moving out the dies to be cleared when the gripper box held on the upper support tube is swung up, whereas the compact method of construction of the lower gripper box leaves sufficient space free to provide a discharge channel for the workpieces from the forming station in a constructional particularly favourable manner closely behind the lower gripper box.

In the device according to the invention, since the connection between the yoke and in particular the support tube, which is the upper support tube with respect to the forming area, is made via a device which can be opened out via a fluid pressure arrangement, the upper gripper box can be swung upward together with the support tube when fluid pressure is removed. During this procedure, the inner space of the gripper box is completely closed from the environment, so that scale, coolant or other contaminating substances, as occur in the working area of a hot press, can never pass into the gripper box and impair the reliable function of the machine elements located in it. Moreover, as a result of the design of the drive shaft according to the invention, the upper gripper box, for the pivoting of which an appropriate positioning device can advantageously be provided, can run with raised grippers, so that the drive between the grippers and the forming machine need not be uncoupled. The retooling and setting-up of the machine when the grippers are raised is also simplified and facilitated by these measures.

An exemplary embodiment of the invention is described in greater detail with reference to the drawings, in which:

FIG. 3 shows a further sectional representation, the section being taken along the line B—B in FIG. 1.

FIG. 4 shows a view of an individual part, shown in FIG. 3, in the direction of the arrow C in FIG. 3.

Figure 1:
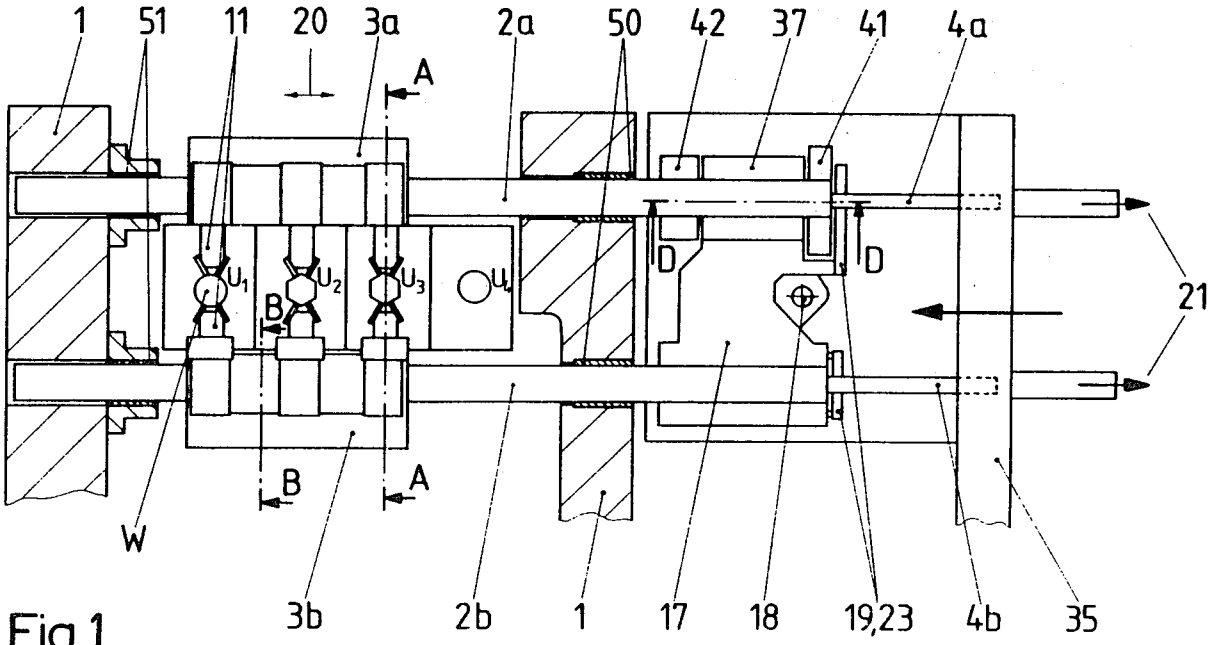
FIG. 1 shows a schematic view of a device according to the features of the invention.

On a machine body 1 shown schematically in FIG. 1, two support tubes **2*a* and 2*b* are rotatably and axially displaceably mounted in two sliding bearings 50 and 51 each and are shown in their left-hand end position in FIG. 1. Four forming stations U1 to U4 of the forming machine are located between the support tubes 2*a* and 2*b*, with it being possible for a workpiece W to be transferred from one forming station to the next in each case by a pair of gripper jaws 11 shown schematically. The gripper jaws 11 are displaceably mounted in rectilinear guides in a row located next to one another in an upper gripper box 3*a* and in a lower gripper box 3*b*. The gripper boxes 3*a* and 3*b* are connected non-rotationally to the support tubes 2*a* and 2*b* during the workpiece transfer and, as schematically shown in FIG. 3, are clamped onto the outer peripheral surface 2*d* of the support tube 2*b***.

In the device portion on the right-hand side in FIG. 1, the support tubes **2*a* and 2*b* are connected via a yoke 17 into a unit displaceable in sliding manner in the workpiece transfer direction and are coupled to a drive mechanism (not shown) via an articulation point 18** of the yoke.

Figure 2:
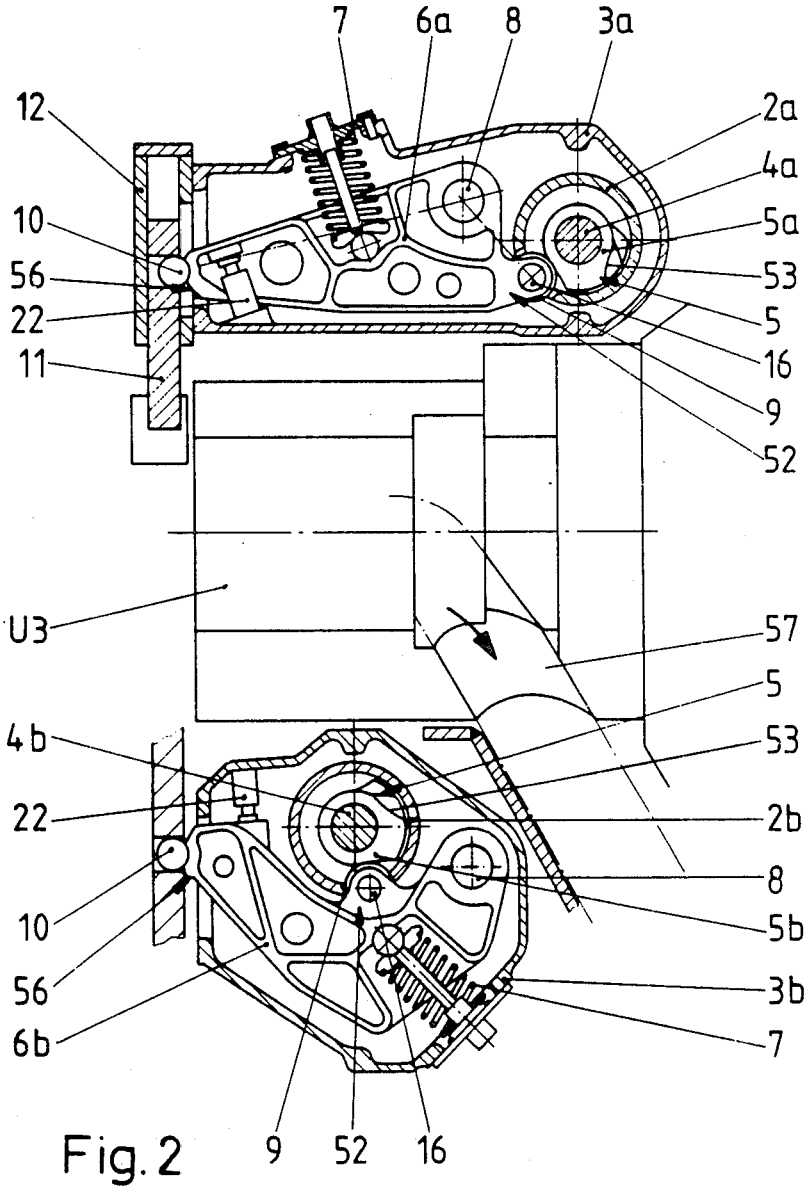
FIG. 2 shows a schematic sectional representation, the section being taken along the line A—A in FIG. 1.

In the sectional representation according to FIG. 2, the support tubes 2a and 2b are seen to have not only the parallel spacing which can be seen in FIG. 1, but also an offset to one another in such a way that the support tube 2b, which is the lower tube with respect to the forming area, is at a smaller distance from the workpiece transfer plane than the upper support tube 2a. In addition, the gripper box 3a of support tube 2a has a shape longitudinally extended relative to the gripper box 3b of the lower support tube 2b, and accommodates a transmission lever 6a for an associated one of the gripper jaws 11 and is pivotably mounted in the form of a double-arm lever on a fixed pin 8. The corresponding transmission lever 6b in the lower gripper box 3b has the form of a single-arm lever, likewise articulated about a fixed pin 8. Thus, both transmission levers 6a and 6b, with lever portions 56 on the gripper side, on each of which portions is located a ball 10, engage on the gripper jaws 11 in order to displace the latter within their gripper supports 12.

In the inner spaces of both support tubes 2a and 2b are respective camshafts 4a and 4b which serve as drive shafts for cam members 5, which pivotally displace of the respective transmission levers 6a and 6b. For this, the cam members 5 are respectively in the form of adjustable fan-type disks 5a and 5b having fan-type disk control faces 53 on which sits shaft drive-side portions 52 of the respective transmission levers 6a and 6b. For respective low-friction drive of the transmission levers 6a and 6b, respective probing rollers 9 are rotatably guided on respective pins 16 of the shaft drive-side portions 52 of the transmission levers. Schematically-shown spring sets 7 appropriately preload the respective transmission levers 6a and 6b and thereby press the probing rollers 9 onto the control faces 53 of the fan-type disks 5a and 5b. It is apparent from FIG. 2 that both gripper jaws 11 are displaced within the gripper supports 12 by the transmission levers 6a and 6b during each revolution of the camshafts 4a and 4b. The closed position of the gripper jaws 11 is schematically depicted in FIG. 2. In FIG. 2, fluid cylinders 22 are shown engaging on each transmission lever 6a and 6b. By means of these fluid cylinders, which can be made, for example, as hydraulic cylinders, the transmission levers can be lifted from the respective fan-type disk control faces 53 against the spring preloading, which is necessary, for example, when replacing the camshafts 4a and 4b mounted inside the support tubes 2a and 2b. Moreover, the fluid cylinders 22 can be operated to prevent the gripper jaws 11 from closing. The fluid cylinders are controlled in this manner, for example, for separating defective preformed pressed parts, as arise, for example, when changing from one material bar to the next. In this procedure, the first gripper is held open via the fluid cylinder 22, so that this defective pressed part cannot be transferred further.

The fan-type disks 5a and 5b are interchangeable on the camshafts 4a and 4b and are adjustably fixed axially of and angularly about the camshafts. Each fan-type disk can thereby be set on the camshaft independently of the others in such a way that a control optimally adapted to the corresponding forming operation can be achieved for each gripper jaw pair 11.

A bearing arrangement 54 is used for achieving quick interchangeability of the camshafts 4a and 4b and at the same time a precision mounting of the respective camshaft over a considerable axial extent within the support tubes 2a and 2b, which bearing arrangement, according to FIG. 3, comprises an antifriction bearing 15, the inner ring 15b of which sits on the camshaft 4b and the outer ring 15a of which has a smaller diameter than the inside diameter of the supprt tube 2b. Supporting pins 14 which pass through the wall of the support tube 2b are used for bridging the difference in diameters, which supporting pins are provided in grouped manner, distributed at angular distances, about the outer ring 15a in the peripheral direction of the respective antifriction bearing 15 and, with their end faces 14a which face toward the outer ring peripheral surface 15d, support the entire antifriction bearing 15 centrally in the manner of a steady rest. With regard to production, it is of advantage that realizing the bearing arrangement 54 only makes it necessary to produce the external peripheral surface 2d to a specified diameter with a narrow tolerance range and to machine with corresponding precision the supporting pins 14, which, with their shank which can be seen in FIG. 4, are guided through bores provided in the support tube wall, and to support them, with their pin end faces 14c which sit against the peripheral surface 2d, on an inner surface 3c which is clamped onto this outer peripheral surface 2d of the relevant support tube and is a component part of the fixing portion of the gripper box 3a and 3b. The view of the supporting pin 14 according to FIG. 4 shows that its pivot end face 14c, in contrast to the cylindrical pin shank, is square and, as can be recognised from FIG. 3, is provided with a curvature corresponding to the radius of the inner surface 3c of the said fixing portion. As is clearly shown, this specific shaping of the supporting pin 14 produces a reliable mounting of the antifriction bearing 15 in the respective support tube when the machining of the outer peripheral surface 2d is appropriated adapted.

Figure 5:
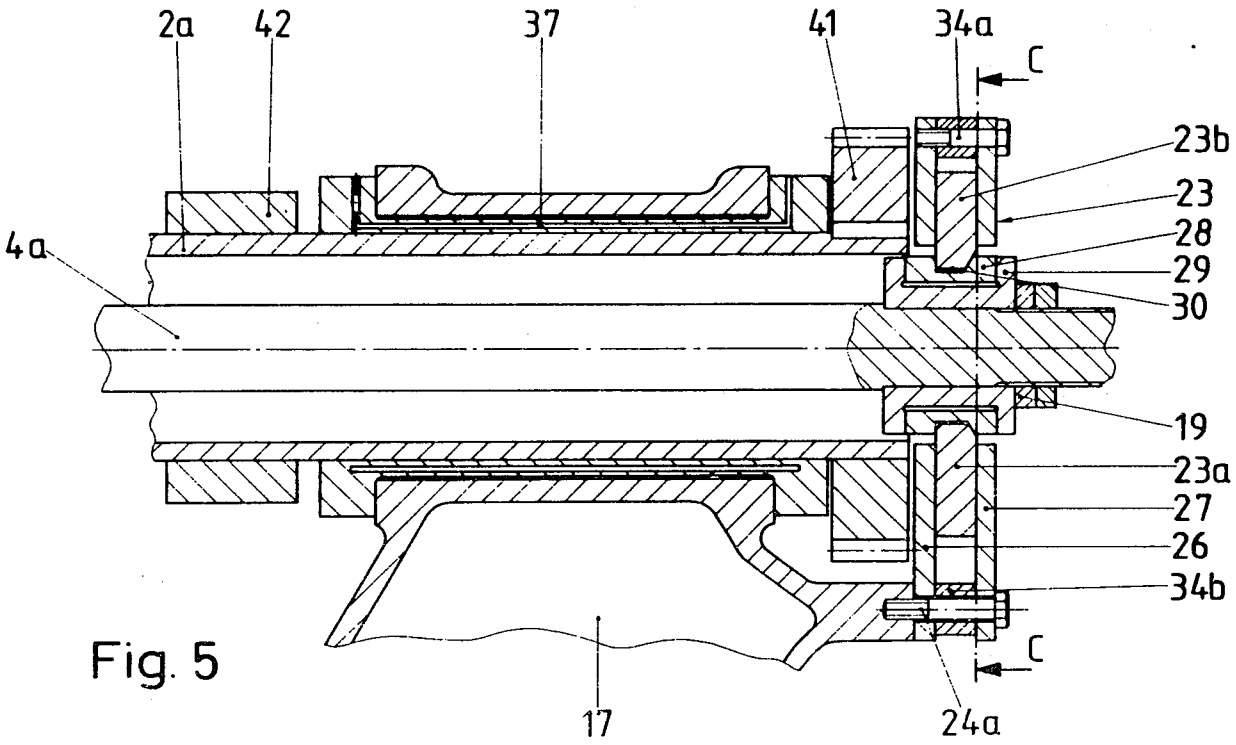
FIG. 5 shows a sectional representation of a device portion in FIG. 1 along the arrows D—D in FIG. 1

In the sectional representation according to FIG. 5, the portion of the yoke 17, according to FIG. 1, which portion contains the upper support tube 2a, is shown in detail. The support tube 2a is connected to the shown portion of the yoke 17 via a device 37 engaging on its outer periphery. By introducing a fluid into one or more annular channels in the device 37, the latter is opened out and a non-positive connection can thereby be made between the support tube 2a and the yoke 17. In the condition ready for cross transfer, both support tubes 2a and 2b (FIG. 1), with the yoke 17, are connected into a unit displaceable in sliding manner. Next to the end of the support tube 2a, which end is the right-hand end according to FIG. 5, an axial bearing 19 is located on the camshaft 4a, which axial bearing 19 has a bearing ring 29 which is firmly connected to the camshaft 4a and, in its outer peripheral area, supports a coupling member 28 which is radially mounted in floating manner. A locking arrangement 23 is screwed onto the yoke 17 at several fixing locations 24a and 24b (cf. FIGS. 6 and 7) and in the radial direction has locking bars 23a and 23b which engage into the axial bearing 19 and, in their engagement position according to FIG. 5, make a rigid connection in the axial direction between the support tube 2a and the camshaft 4a. In such a connection toward the articulation point 18 of the yoke 17 (FIG. 1), if the yoke is set in a periodically oscillating longitudinal motion in the direction of the double arrow 20 via a connecting rod (not shown) of a known cam coupler mechanism, the yoke correspondingly moves the camshafts 4*a* and 4*b* along via the support tubes 2*a* and 2*b*. The respective stroke of the cross transfer corresponds to the center distance between two adjacent forming stations U1 to U4 according to FIG. 1.

Figure 6:
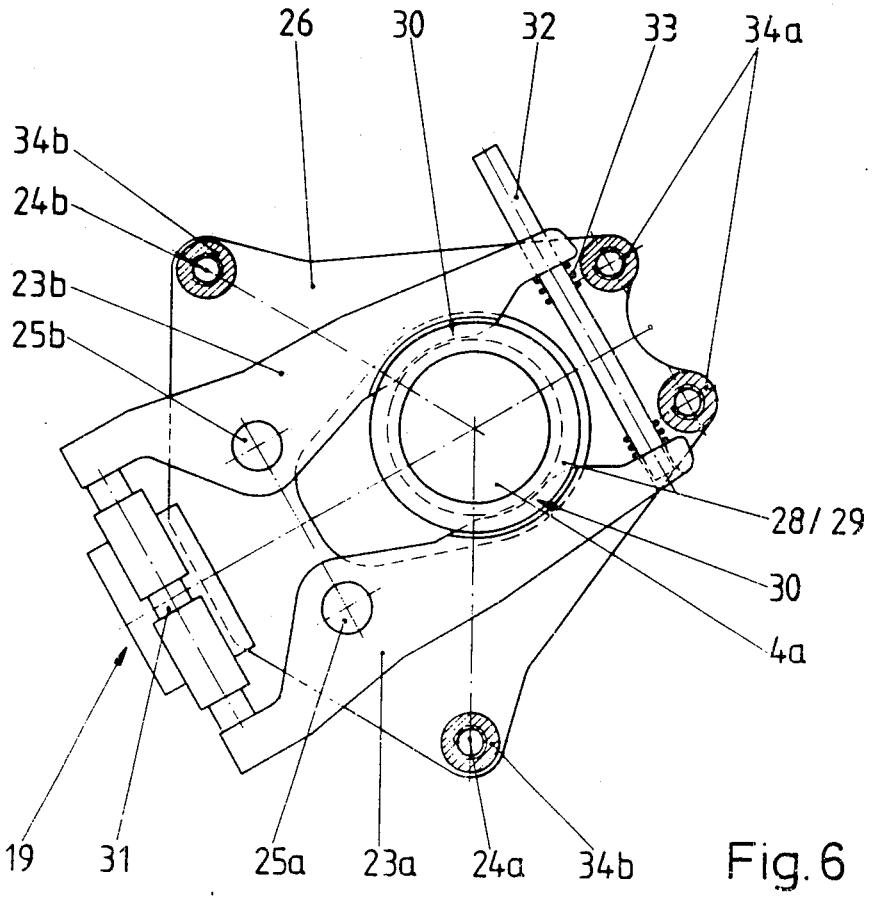
FIG. 6 shows a cross-sectional view, the section being taken along the line C—C in FIG. 5.
Figure 7:
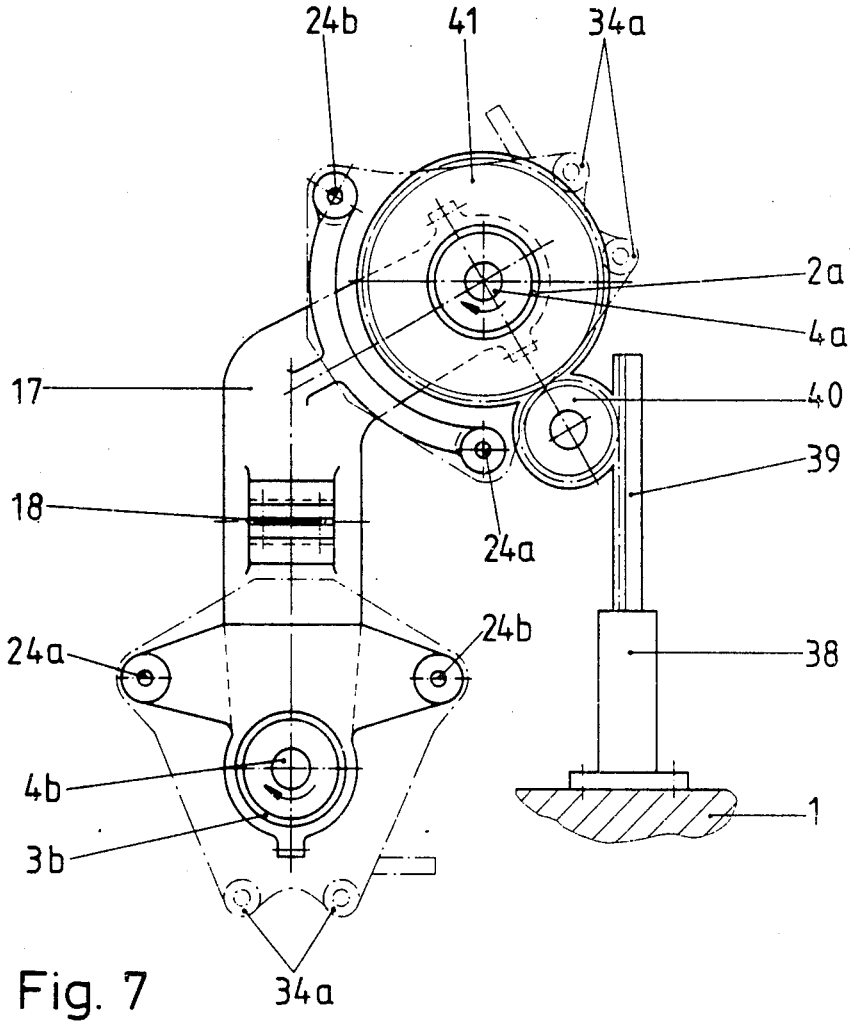
FIG. 7 shows a view of the device portion on the right-hand side of FIG. 1 in the direction of the arrow A, with the axial bearings 19 which are shown schematically in FIG. 1 being omitted.

So that the camshafts 4*a* and 4*b* can be drawn out of the support tubes 2*a* and 2*b*, the locking arrangement 23 has to be released. According to FIG. 5, its locking bars 23*a* and 23*b* are displaceably guided between locking guide plates 26 and 27, with the mutual spacing of the guide plates at the fixing locations 24*a* and 24*b* being established via corresponding spacer sleeves 34. It is apparent from FIG. 6 that the locking bars 23*a* and 23*b* are displaceable about pivot pins 25*a* and 25*b* and that a spring 33 sitting on a guide pin 32 is provided at the end area of the locking arrangement 23 between the locking bars 23*a* and 23*b*, which end area is the lower end area according to FIG. 6, and a fluid cylinder arrangement 31 is provided at the end portions of the locking bars 23*a* and 23*b*, which end portions are located opposite with respect to the pivot pins 25*a* and 25*b*. It is apparent from the respresentation in FIG. 6 that the locking bars 23*a* and 23*b* are swung out of the depicted locking position via the spring 33 as soon as the fluid pressure in the cylinder arrangement 31 is removed, which fluid pressure is exerted during locking. When the fluid pressure is accordingly reapplied, the locking arrangement 23 can be closed again. FIG. 5 and 6 only show the axial bearing 19 and the locking arrangement 23 for the according to FIG. 1 upper support tube arrangement. A corresponding construction is provided for the support tube 2*b* and the camshaft 4*b*. To be able to draw the camshafts 4*a* and 4*b* axially out of the corresponding support tube 2*a* and 2*b* (arrow 21), the fluid cylinders, shown schematically in FIG. 2, in addition to the releasing of the locking arrangement 23, are to be actuated in such a manner that they disengage the transmission levers 6*a* and 6*b* from the fan-type disks 5*a* and 5*b*.

The camshafts 4*a* and 4*b* are set in rotation by the main drive of the forming machine via a chain and gearwheel drive schematically shown in the form of a box in FIG. 1. As a result of the axial movement of the camshafts, which takes place at the same time, this rotary movement is transmitted by means of splined shafts (not shown).

To swing up the upper gripper box 3a together with the support tube 2*a* out of the position shown in FIGS. 1 and 2, the connection between the support tube 2*a* and the yoke 17 via the hydraulically opened-out aforementioned device 37 is broken by removing the hydraulic pressure. The upper gripper box is swung up by actuating a hydraulic cylinder according to FIG. 7 which displaces a toothed rack 39 which sets a gear wheel 41 in rotation via a pinion 40, which gear wheel 41, as is apparent from FIG. 5, is arranged non-rotationally on the end portion of the support tube 2*a* via a keyed connection. As soon as the support tube 2*a* turns in accordance with the stroke of the hydraulic cylinder 38 and has thus brought the upper gripper box 3*a* into an upper pivot position, the device is again opened out hydraulically, and the gripper box is reliably supported by the yoke 17 in its upper pivot position via the renewed press connection.

The gear wheel 41 is moved along during the cross transfer of the yoke 17, for which reason the pinion 40, for a pivoting capacity of the upper gripper box 3*a* in any axial position of the support tube, must have such a width that it corresponds at least to the cross transfer stroke plus the thickness of the gear wheel 41. If these conditions are fulfilled, the pinion 40 and the gear wheel 41 can remain constantly engaged. To keep the wear between the pinion and the gear wheel as low as possible and so that, moreover, no forces are exerted on the pivoting arrangement during the operation of the device, the tooth clearance between the pinion 40 and the gear wheel 41 is made relatively large.

Figure 8:
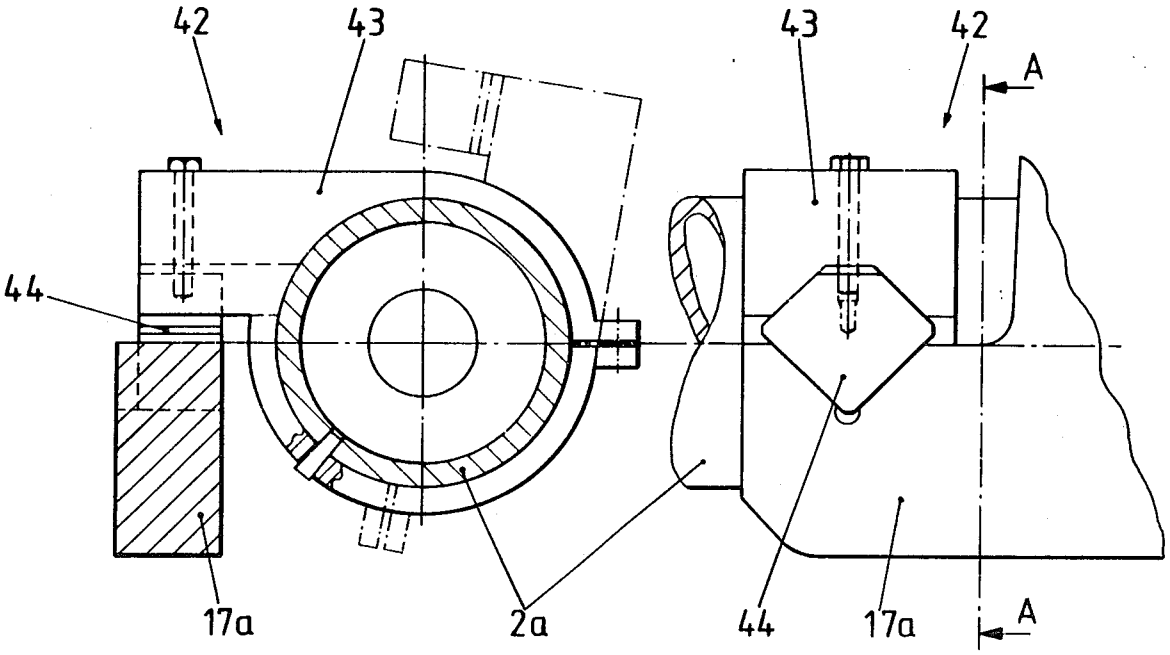
FIG. 8 shows a schematic representation in front and side elevation of a positioning device.

So that an accurate reproduction of the initial position and therefore a repeatable positionally correct interaction of the upper and lower gripper jaws 11 is possible after the upper gripper box 3*a* has been swung up, the exact working position of the support tube 2*a* must be accurately located in both the axial and radial direction. A positioning device 42 is used for this purpose which has a bracket 43 which is screwed onto the support tube 2*a* and has a milled contour in which a positioning V-block is fixed. A screw shown schematically in the right-hand illustration according to FIG. 8 is used for fixing. A contour complementary to the V-block 44 is recessed into a yoke portion 17*a* of the yoke 17, which yoke portion 17*a* projects in the pivoting direction of the support tube 2*a* opposite the positioning V-block 44, so that the support tube is reliably adjusted axially and radially via the positioning V-block 44 and the contour in the yoke portion 17*a* above all during the last phase of the return pivoting movement into its initial position. When the gripper box 3*a* is located in its swung-up position, the bracket 43, according to the left-hand position in FIG. 8, is swung into its position drawn in chain-dotted lines.

I claim:

1. In a multistage forming machine having two axially displaceable support tubes, camshafts respectively rotatable in the support tubes, cam members on the respective camshafts for rotation therewith, each cam member having a control face, transmission levers pivotably shiftable by the respective cam members upon their rotation with the camshafts, and gripper-jaw and displacing means on the support tubes and comprising pairs of gripper jaws for displacing the gripper jaws of each pair with shifting of respective transmission levers, whereby to grip workpieces in each stage of the multistage forming machine and move the workpiece between the stages thereof with the axial displacement of the support tubes, the improvement comprising:

drive means for continuously rotating the camshafts;

cam-fixing means for detachably fixing the cam members adjustable axially of and angularly about the camshafts the cam members are respectively on;

marking means on the cam members and camshafts for setting at least the angular adjustment of the cam members about the camshafts the cam members are respectively on;

shaft drive-side portions of the respective transmission levers at the respective camshafts of the cam members shifting the same; and probing rollers rotatably on the respective shaft drive-side portions of the transmission levers and respectively pressed against the control faces of the cam members for the shifting of the transmission levers.

2. The forming machine of claim 1, wherein the cam members are fan-type discs.

3. The forming machine of claim 2, wherein:

the fan-type disc cam members on one of the camshafts are respectively identical to those on the other of the camshafts; and the drive means rotates the camshafts in the same direction; and further comprising:

antifriction bearing rings rotatably about the respective camshafts and having a smaller outside-surface diameter than the support tubes the camshafts are in;

supporting pins projecting from radial bores angularly spaced about each support tube at each bearing ring into the support tube to the respective outside surfaces of the bearing rings for holding the outside surfaces of the bearing rings concentrically and steadily in the support tube; and penetration means for adjusting the projection of the supporting pins into the support tubes from outside the support tubes.

4. The forming machine of claim 3, wherein the gripper-jaw and displacing means further comprises gripper boxes for the respective gripper jaws, each gripper box extending about one of the support tubes at the supporting pins projecting thereinto and sitting against ends of the supporting pins thereat for clamping the supporting pins in the support tube, whereby, upon precision machining of the peripheral surface of the support tube thereat, the surface of the gripper box thereabout, and the ends of the supporting pins, the clamping is precise.

5. The forming machine 1, and further comprising:

a yoke rotatably supporting one end of each support tube for connection to axial drive means for moving the yoke and support tubes axially of the latter;

locking-arrangement means on the yoke and axial-bearing means respectively on the camshafts and releasably cooperative with the locking-arrangement means for rotationally supporting the camshafts on the yoke and axially moving the camshafts with the yoke; and fluid-cylinder means shifting the transmission levers for disengaging the probing rollers from pressing against the control faces of the cam members, whereby, upon release of the cooperation between the locking-arrangement and axial-bearing means and disengaging of the probing rollers, the camshafts can be drawn axially out of the support tubes.

6. The forming machine of claim 5, wherein:

each of the axial-bearing means comprises a bearing ring fixed to the camshaft the axial-bearing means is on for rotational and axial movement with the camshaft and a coupling piece on the bearing ring radially floatingly and axially movable therewith; and each of the locking-arrangement means comprises locking bars pivotably mounted on the yoke for movements engaging and disengaging the coupling piece, a spring between the locking bars for moving the locking bars disengagingly from the coupling piece, and a fluid cylinder for moving the locking bars to engage with the coupling piece.

7. The forming machine of claim 1, wherein the drive means comprises gearwheels splined to the respective camshafts for rotation therewith and axial movement relative thereto, and a chain about the gearwheels for rotation thereof.

8. The forming machine of claim 2, wherein the drive means comprises gearwheels splined to the respective camshafts for rotation therewith and axial movement relative thereto, and a chain about the gearwheels for rotation thereof.

9. The forming machine of claim 3, wherein the drive means comprises gearwheels splined to the respective camshafts for rotation therewith and axial movement relative thereto, and a chain about the gearwheels for rotation thereof.

10. The forming machine of claim 4, wherein the drive means comprises gearwheels splined to the respective camshafts for rotation therewith and axial movement relative thereto, and a chain about the gearwheels for rotation thereof.

11. The forming machine of claim 5, wherein the drive means comprises gearwheels splined to the respective camshafts for rotation therewith and axial movement relative thereto, and a chain about the gearwheels for rotation thereof.

12. The forming machine of claim 6, wherein the drive means comprises gearwheels splined to the respective camshafts for rotation therewith and axial movement relative thereto, and a chain about the gearwheels for rotation thereof.

13. The forming machine of claim 5, wherein the yoke means rotatably supporting one of the support tubes comprises:

pivot drive means for rotating the one support tube and, thereby, the gripper-jaw means thereon; and exact position means cooperative between the yoke and one support tube for exact rotational position adjustment of the one support tube relative to the yoke.

14. The forming machine of claim 13, wherein the exact position means comprise a V-block on the one support tube and a cooperative complementary contour on the yoke.

15. The forming machine of claim 1, wherein the transmission levers shifted by the cam members on one of the camshafts are single-arm levers.

16. The forming machine of claim 1, and further comprising springs pivotally urgingly the respective transmission levers for the pressing of the probing rollers against the control faces of the cam members, and fluid cylinders for pivotally shifting the respective transmission levers until the probing rollers are not pressed against the control faces of the cam members. 7

* * * * *